US005656886A

United States Patent [19]

Westphal et al.

[11] Patent Number: 5,656,886

[45] Date of Patent: Aug. 12, 1997

[54] TECHNIQUE TO IMPROVE UNIFORMITY OF LARGE AREA FIELD EMISSION DISPLAYS

[75] Inventors: Michael J. Westphal; Behnam Moradi, both of Boise, Id.

[73] Assignee: Micron Display Technology, Inc., Boise, Id.

[21] Appl. No.: 580,613

[22] Filed: Dec. 29, 1995

[51] Int. Cl.[6] ..... H01J 9/12; H01J 1/62; H01J 63/04; H01J 1/46; H01J 21/10

[52] U.S. Cl. ..... 313/495; 313/309; 313/336; 445/50; 445/51

[58] Field of Search ..... 313/306, 309, 313/311, 336, 346 R, 381, 495; 445/50, 51

[56] References Cited

U.S. PATENT DOCUMENTS

| | | | |
|---|---|---|---|
| 3,500,102 | 3/1970 | Crost et al. | 313/109 |
| 4,940,916 | 7/1990 | Borel et al. | 313/306 |
| 5,210,472 | 5/1993 | Casper et al. | 315/349 |
| 5,212,426 | 5/1993 | Kane | 315/169.1 |
| 5,359,256 | 10/1994 | Gray | 313/169 |
| 5,394,006 | 2/1995 | Liu | 445/50 X |
| 5,548,181 | 8/1996 | Jones | 313/309 |

OTHER PUBLICATIONS

K. Yokoo, et al., "Active Control of Emission Current of Field Emitter Array", Revue Le Vide, les Couches Minces, Suppl. No. 271, Mar.–Apr. 1994.

*Primary Examiner*—Sandra L. O'Shea
*Assistant Examiner*—Mack Haynes
*Attorney, Agent, or Firm*—Hale and Dorr LLP

[57] ABSTRACT

Cold cathode passive matrix FEDs are fabricated by depositing a resistive layer on a substrate, and coated with a protective layer in which at least one hole is formed. Cathode material is deposited on the protective layer making direct contact with the resistive layer through the hole to form bases for the emitter tips which are subsequently etched from the cathode layer. The protective layer allows overetching of the cathode material to prevent tip-to-tip electrical shorts without attacking the underlying resistive layer.

24 Claims, 1 Drawing Sheet

TECHNIQUE TO IMPROVE UNIFORMITY OF LARGE AREA FIELD EMISSION DISPLAYS

GOVERNMENT RIGHTS

This invention was made with Government support under Contract No. DABT63-93-C-0025, awarded by the Advanced Research Projects Agency (ARPA). The Government has certain rights in this invention.

BACKGROUND OF THE INVENTION

The present invention pertains to a technique to improve emitter tip uniformity on large area passive matrix cold cathode field emission displays and, in particular, to the resulting improved product.

Field emission display (FED) technology utilizes a matrix addressable array of pointed, thin film, cold field emission cathodes in combination with a phosphor luminescent screen. U.S. Pat. No. 4,940,916 discloses an electron source, with micropoint emissive cathodes, and display means by cathodoluminescence excited by field emission from the electron source. Each cathode has an electrically conductive layer, a continuous resistive layer on the conductive layer and a patterned array of a plurality of micropoints. The display includes a cathodoluminescent anode facing the source. A further example can be found in U.S. Pat. No. 5,210,472, the disclosures of both of these patents being incorporated herein by reference. An emissive flat panel display operates on the principles of cathodoluminescent phosphors excited by cold cathode field emission electrons. A faceplate having a cathodoluminescent phosphor coating receives patterned electron bombardment from an opposing baseplate thereby providing a light image which can be seen by a viewer. The faceplate is separated from the base plate by a vacuum gap and, in some embodiments, the two plates are prevented from collapsing together by physical standoffs or spacers fixed between them.

The baseplate of a field emission display is comprised of arrays of emission sites (emitters) which are typically sharp cones that produce electron emission in the presence of an intense electric field, an extraction grid disposed relative to the sharp emitters provides the intense positive voltage for the electric field and a means for addressing and activating the generation of electron beams from those sites. Varying the charge which is delivered to the phosphor in a given pixel from an emission array will vary the light output (brightness) of the pixel associated with it. Two techniques for varying the charge delivered by an emission array are to either vary the time period of activation (duty cycle) or to vary the emission current.

Fabrication of FEDs utilizes high resolution lithography and etching to create openings in a metal-semiconductor-dielectric sandwich. Problems can arise in either, or both, over-etching and under-etching the semiconductor layer used to form the emitter tips. Previous processing sequences presented difficulties in adequately etching the tip layer without over etching the underlying resistive layer. The result was shorted emitter tips (under-etching) or variable resistive layer thicknesses for different areas of the array (over-etching). Any variation of the thickness of the resistor layer results in low pixel yield and poor uniformity across the array. By following the sequence specified by the present invention, the uniformity and yield problems of the prior art are minimized. For example, in addition to the above mentioned patents, see U.S. Pat. Nos. 3,500,102; 5,212,426; and 5,359,256, all of which are incorporated herein by reference.

SUMMARY OF THE INVENTION

The present invention concerns a method for constructing cathode tips in large area passive matrix cold cathode field emission flat panel display devices by providing a substrate having address components disposed therein; depositing a resistive layer on the address components; depositing a protective layer on the resistive layer and etching at least one hole therein reaching to the resistive layer; depositing cathode material directly on the protective layer and through the at least one hole into contact with the resistive layer; and etching the cathode material to form at least one emitter tip. The protective layer allows complete etching of the cathode material to obviate shorting between tips without damaging the resistive layer.

The present invention further concerns a large area passive matrix cold cathode field emission flat panel display including an anode and a cathode disposed opposite the anode whereby electrons emitted from the cathode strike phosphors on the anode causing the phosphor to luminesce, the cathode being formed from a substrate having an address component thereon; a resistive layer deposited directly on the substrate; a protective layer deposited directly on the resistive layer with a hole formed therein; and a cathode material deposited directly on the protective layer and through the hole into contact with the resistive layer.

The present invention still further concerns a large area passive matrix cold cathode field emission flat panel display constructed with cathode tips uniformly formed by providing a substrate having address components disposed therein; depositing a resistive layer on the address components; depositing a protective layer on the resistive layer and forming at least one hole in the protective layer reaching to the resistive layer; depositing cathode material directly on the protective layer and through the at least one hole into contact with the resistive layer; and etching the cathode material to form emitter tips, each of which electrically contacts the resistive layer through a respective hole in the protective layer. The protective layer allows complete etching of the cathode material to obviate shorting between tips without damaging the resistive layer.

BRIEF DESCRIPTION OF THE DRAWINGS

The present invention will now be described, by way of example, with reference to the accompanying drawings in which.

DETAILED DESCRIPTION OF THE PREFERRED EMBODIMENT

Figure 1:
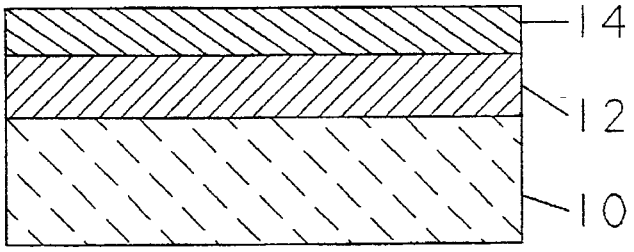
FIG. 1 Prior Art
FIG. 1 is a schematic section through a prior art baseplate prior to etching.
Figure 2:
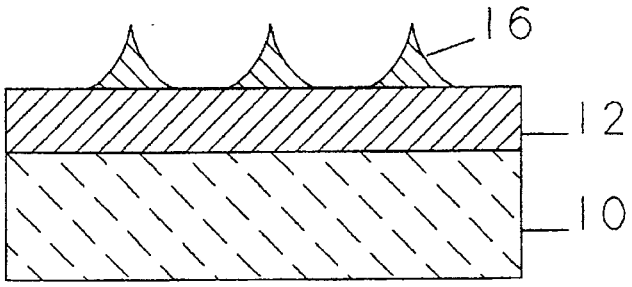
FIG. 2 Prior Art
FIG. 2 is a schematic section through the prior art baseplate after etching.
Figure 3:
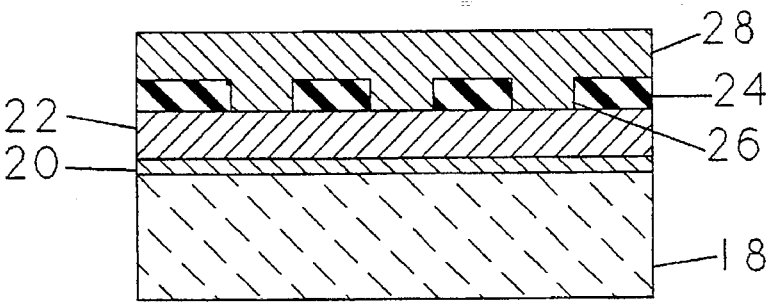
FIG. 3 is a schematic section through a baseplate according to the present invention prior to final etching.
Figure 4:
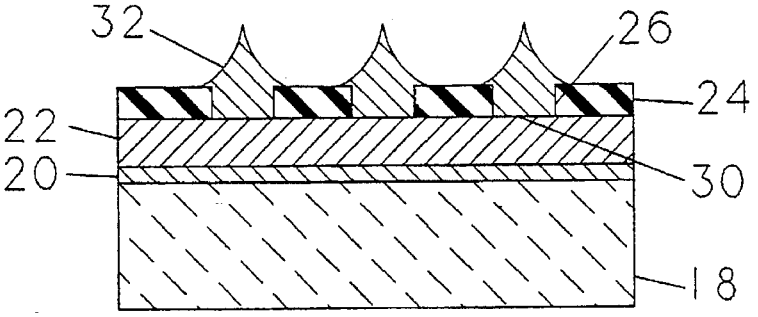
FIG. 4 is a schematic section through the baseplate according to the present invention after final etching.

Turning first to the prior art shown in FIGS. 1 and 2, a substrate 10, such as glass, has a resistive layer 12 deposited thereon to form the resistive layer in a passive matrix field emission display device (not shown). This resistive layer can be amorphous, microcrystalline, or polycrystalline silicon. Other semiconductor thin films which have desired resistive characteristics may also be used. Cathode material 14, such as amorphous silicon, is deposited directly on top of the resistive layer 12 and then etched to form the emitter tips 16.

The difficulty lies in accurately etching the cathode layer 14. Under-etching could leave conductive portions of layer 14 so that the emitter tips 16 are shorted together by the unetched cathode material. Over-etching the resistive layer 12 could result in nonuniform resistor values and low pixel yield. Either condition would remit in poor emission uniformity across the array.

The present invention overcomes the above problem. The present invention starts with a substrate 18, such as glass, with a cap layer 20, such as deposited $SiO_2$, with a resistive layer 22, such as amorphous, microcrystalline, or polycrystalline silicon, deposited thereon forming the resistive layer for a passive matrix field emission display device. Resistive layer 22 may be formed from a thin silicon film by a conventional process. A protective layer 24, such as a layer of dielectric material, is then placed on the resistive layer 22 and etched to form a patterned array of a plurality of holes 26 reaching to the resistive layer 22. A layer of cathode material 28, such as amorphous silicon, is deposited directly on top of the protective layer 24 and contacts the resistive layer 22 through holes 26 forming conductive bases 30. Cathode material 28 may be formed from a thin silicon film by a conventional process. The cathode material 28 is then etched to form the emitter tips 32. Each tip 32 is in direct electrical contact with resistive layer 22 by a respective base 30.

The inverse field of a tip etch mask (not shown) can be used as a contact mask to etch the base holes 26 in the protective layer 24 before the layer of cathode material 28 is deposited. The cathode tips 32 and contact bases 30 will tolerate a certain amount of overetch, but severe overetch will attack the resistive layer 22. Each cathode tip 32 electrically contacts a respective contact base 30 and thereby the resistive layer 22. This will allow the layer of cathode material 28 to be completely removed between the tips 32, and ensure that the resistive layer 22 is not attacked during etching of the layer of cathode material 28. The thickness of the protective layer 24 can be adjusted to a value appropriate for the etch selectivity between the cathode layer 28 and the protective layer 24. Thus sufficient over-etch of the amorphous silicon can be allowed without completely eroding the protective layer 24. The present invention provides greater etch process latitude than for the prior art in which the two silicon films are deposited directly on top of each other. The diameter of the bases 30 preferably should be smaller than the base of the tips 32, otherwise the resistive layer 22 may be eroded during the tip etch. The bases also serve to accommodate for some misalignment of the tips 32. The tips 32 have been shown on top of respective bases 30, without any offset, simply for ease of illustration.

Suitable substrates for the present invention would include sodalime glass, and borosilicate glass, such as Corning 7059.

The resistive layer can be formed from amorphous, microcrystalline, or polycrystalline silicon or any other semiconductor thin film with the desired electrical characteristics.

The protective layer can be formed from $SiO_2$, $Si_3N_4$, and oxynitride.

The cathode layer can be formed from amorphous, microcrystalline, or polycrystalline silicon or other semiconductor thin film with the desired electrical properties.

The protective layer can be etched with either wet or dry etches which are commonly used to etch $SiO_2$, $Si_3N_4$, or oxynitride.

The cathode layer can be etched with $CF_6$.

The present invention may be subject to many modifications and changes without departing from the spirit or essential, characteristics thereof. The present embodiment should therefor be considered in all respects as being illustrative and not restrictive of the scope of the invention as defined by the appended claims.

We claim:

1. A method for constructing cathode tips in large area passive matrix cold cathode field emission flat panel display devices comprising the steps of:

providing a substrate having address components disposed therein;

depositing a resistive layer on said address components;

depositing a protective layer on said resistive layer and etching at least one hole in the protective layer reaching to said resistive layer;

depositing cathode material directly on said protective layer and through said at least one hole into contact with said resistive layer; and etching said cathode material to form at least one emitter tip whereby said protective layer allows complete etching of the cathode material to obviate shorting between tips without damaging the resistive layer.

2. The method according to claim 1 wherein the substrate comprises glass.

3. The method according to claim 2 wherein the glass comprises sodalime or borosilicate glass.

4. The method according to claim 1 wherein the resistive layer comprises amorphous, microcrystalline, or polycrystalline silicon.

5. The method according to claim 1 wherein the protective layer comprises a dielectric material.

6. The method according to claim 5 wherein the dielectric material comprises silicon dioxide.

7. The method according to claim 1 wherein the cathode material comprises amorphous, microcrystalline, or polycrystalline silicon.

8. A large area passive matrix cold cathode field emission flat panel display including an anode and a cathode disposed opposite the anode whereby electrons emitted from the cathode strike phosphors on the anode causing the phosphor to luminesce, the cathode comprising:

a substrate having an address component thereon;

a resistive layer deposited directly on said substrate;

a protective layer deposited directly on said resistive layer and having a hole formed therein; and a cathode material deposited directly on said protective layer and through said hole into contact with said resistive layer.

9. The display according to claim 8 wherein the substrate comprises glass.

10. The display according to claim 9 wherein the glass comprises sodalime or borosilicate glass.

11. The display according to claim 8 wherein the resistive layer comprises amorphous, microcrystalline, or polycrystalline silicon.

12. The display according to claim 11 wherein said resistive layer is microcrystalline silicon.

13. The display according to claim 8 wherein the protective layer comprises a dielectric material.

14. The display according to claim 13 wherein the dielectric material comprises silicon dioxide.

15. The display according to claim 8 wherein the cathode material comprises thin silicon films.

16. A large area passive matrix cold cathode field emission flat panel display constructed with cathode tips uniformly formed by:

providing a substrate having address components disposed therein;

depositing a resistive layer on said address components;

depositing a protective layer on said resistive layer and etching at least one hole in the protective layer reaching to said resistive layer;

depositing cathode material directly on said protective layer and through said at least one hole into contact with said resistive layer; and etching said cathode material to form at least one emitter tip whereby said protective layer allows complete etching of the cathode material to obviate shorting between tips without damaging the resistive layer.

17. The display according to claim 16 wherein the substrate comprises sodalime or borosilicate glass.

18. The display according to claim 16 wherein the resistive layer comprises thin silicon films.

19. The display according to claim 16 wherein said resistive layer comprises microcrystalline silicon.

20. The display according to claim 16 wherein the protective layer comprises a dielectric film.

21. The display according to claim 16 wherein the protective layer comprises a dielectric material.

22. The display according to claim 21 wherein the dielectric material comprises silicon dioxide.

23. The display according to claim 16 wherein the cathode material comprises thin silicon films.

24. The display according to claim 16 wherein the cathode material comprises amorphous, microcrystalline, or polycrystalline silicon.

* * * * *